US007331089B2

(12) United States Patent
Christensen

(10) Patent No.: US 7,331,089 B2
(45) Date of Patent: Feb. 19, 2008

(54) METHOD AND APPARATUS FOR DRY FORMING OF A FABRIC

(75) Inventor: Kenn Mosgaard Christensen, Risskov (DK)

(73) Assignee: Dan-Web Holding A/S, Risskov (DK)

( * ) Notice: Subject to any disclaimer, the term of this patent is extended or adjusted under 35 U.S.C. 154(b) by 68 days.

(21) Appl. No.: 10/555,247

(22) PCT Filed: Apr. 28, 2004

(86) PCT No.: PCT/DK2004/000289

§ 371 (c)(1),
(2), (4) Date: Dec. 1, 2005

(87) PCT Pub. No.: WO2004/097097

PCT Pub. Date: Nov. 11, 2004

(65) Prior Publication Data

US 2006/0230589 A1 Oct. 19, 2006

(30) Foreign Application Priority Data

May 1, 2003 (DK) ..... 2003 00661

(51) Int. Cl.
*D01G 25/00* (2006.01)

(52) U.S. Cl. ..... 28/103; 19/296

(58) Field of Classification Search ..... 28/104, 28/105, 103, 106, 167, 165; 19/296, 308, 19/304, 307, 161.1, 302; 156/148, 62.2; 264/121, 109, 122; 162/202, 203
See application file for complete search history.

(56) References Cited

U.S. PATENT DOCUMENTS 3,824,086 A 7/1974 Perry et al.
4,292,271 A * 9/1981 Buob et al. ..... 264/128
4,463,048 A 7/1984 Dickson et al.
4,483,745 A * 11/1984 Wicks et al. ..... 162/205
4,668,322 A * 5/1987 Christensen ..... 19/296
5,169,700 A 12/1992 Meier et al.
5,414,902 A * 5/1995 Kroyer ..... 19/305
5,873,963 A * 2/1999 Trombetta et al. ..... 156/62.2
6,007,653 A * 12/1999 Pirinen et al. ..... 156/148
6,141,833 A * 11/2000 S.o slashed.rensen ..... 19/308

(Continued)

FOREIGN PATENT DOCUMENTS

DK 172260 2/1998

(Continued)

*Primary Examiner*—A. Vanatta
(74) *Attorney, Agent, or Firm*—James Creighton Wray; Clifford D. Hyra

(57) ABSTRACT

A method and apparatus is described for use in dry forming a fabric by at least two non-woven fabrics. The upper run of the transfer wire is used as a forming wire. A forming head is disposed above the transfer wire. An airlaid non-woven fabric is formed on the transfer wire. This non-woven fabric is carried with the transfer wire onto the top side of the first non-woven fabric. The first non-woven fabric is formed on a preceding forming wire and transferred by the transfer wire to a subsequent conveying wire. This subsequent conveying wire can also be a forming wire so further non-woven fabric can be formed before the fabric is consolidated, e.g. by hydroentanglement or latex bonding/fibre bonding.

14 Claims, 4 Drawing Sheets

U.S. PATENT DOCUMENTS

| | | | | |
|---|---|---|---|---|
| 6,375,773 | B1 * | 4/2002 | Andersen | 156/148 |
| 2002/0092884 | A1 | 7/2002 | Fleissner | |
| 2002/0168910 | A1 * | 11/2002 | Vuillaume et al. | 442/381 |
| 2003/0217448 | A1 * | 11/2003 | Andersen | 28/104 |
| 2005/0091811 | A1 * | 5/2005 | Billgren et al. | 28/104 |

FOREIGN PATENT DOCUMENTS

| | | |
|---|---|---|
| GB | 2125450 | 3/1984 |
| WO | WO 01/23313 | 4/2001 |

* cited by examiner

METHOD AND APPARATUS FOR DRY FORMING OF A FABRIC

This application claims the benefit of Danish Application No. PA 2003 00661 filed May 1, 2003 and PCT/DK2004/000289 filed Apr. 28, 2004, which are hereby incorporated by reference in their entirety.

BACKGROUND OF THE INVENTION

The present invention concerns a method for dry forming a fabric. The invention also concerns an apparatus for dry forming a fabric formed of at least two non-woven fabrics.

It is prior art to dry form a fabric with one or more non-woven fabrics which are formed on a former wire or several succeeding former wires. The dry forming can only occur by using cards or former heads.

When making fabrics it is often desirable to combine non-woven fabrics with different properties, so that the finished fabric appears as an integrated product with different properties, e.g. varying density across the thickness of the combined web.

When making an integrated product formed of several non-woven fabrics with large layer thickness, an attachment problem will arise from the vacuum box disposed under a former wire. When placed several former heads are arranged in succession, the layer thickness of the last former head in a series of distributed fibre layers will be subjected to a rather small suction action, since the vacuum effect will only penetrate through the already formed fabric with difficulty. Alternatively, it will be necessary to work with differentiated suction boxes under the former wire for establishing greater and greater vacuum in the conveying direction of the former wire.

It may also be required to reduce the conveying speed of the former wire in order to achieve sufficient vacuum effect through the formed fabric. This entails a reduced efficiency for the apparatus.

By known apparatuses, where a fabric is formed by using two succeeding cards, it may also be wanted to place an intermediate non-woven fabric interposed between the two non-woven fabrics formed by the cards. However, it is difficult to establish vacuum in an area between two cards, and this means that it may be difficult to gent an airlaid gauze layer placed between two cards in an existing apparatus. Such a product consisting of carded non-woven fabrics, which are disposed at both sides of an airlaid non-woven fabric, may e.g. be suited for so-called wipe products.

It is the purpose of the invention to indicate a method and an apparatus that enable combining different non-woven fabrics and which avoid problems with need for larger vacuum by thicker layers, and which in addition are suited for use by formation of an airlaid non-woven fabric between two succeeding cards.

SUMMARY OF THE INVENTION

According to a first aspect of the present invention, this is achieved by a method being peculiar in that a first non-woven fabric is formed and transferred between two forming or conveying wires by a transfer wire in a traditional way, that an airlaid, second non-woven fabric is formed at the top side of an upper run on the transfer wire by using at least one forming head, and that the non-woven fabric is led downwards and along the underside of the lower run of the transfer wire for being laid off on a subsequent conveying wire together with the first non-woven fabric.

According to a second aspect of the invention, this is achieved by a method which is peculiar in that a first non-woven fabric is formed in a first dry forming unit, as fibres are deposited on a first former wire over a vacuum box, that the fibre layer is transferred from the first former wire to the underside of a lower run on a transfer wire, as a vacuum is formed between the upper and lower runs of the transfer wire, that on the top side of the upper run of the transfer wire there is formed an airlaid second non-woven fabric by using at least one former head, and that said first non-woven fabric is sucked against the transfer wire and thereby also against the lower run by suction action through the second non-woven fabric, and that the two non-woven fabrics are transferred to a subsequent conveying wire being optionally a further former wire for forming a third non-woven fabric, preferably a carded non-woven fabric, upon the two previously formed non-woven fabrics.

An apparatus according to the invention is peculiar in that it includes a transfer wire which is disposed after a first former wire used for forming a first non-woven fabric, that at least one former head is placed at the top side of the upper run of the transfer wire, and that a vacuum box is provided between the upper and lower runs of the transfer wire.

When a first non-woven fabric is formed with a desired thickness, either as an airlaid non-woven fabric or as a carded non-woven fabric, or a combination of both, it will normally be integrated by being passed through a nip between two compacting rollers which are provided under the former wire and over it or on the non-woven fabrics placed thereon. The integrated non-woven fabric is then passed in the usual way in under a transfer wire in which there is a vacuum in between the upper and lower runs of the transfer wire. The non-woven fabric is, however, sucked against the underside of the lower run and is then laid off on a succeeding conveying wire. The succeeding conveying wire can be a further former wire, where a card, or alternatively a former head, is placed for forming one or more additional non-woven fabrics.

By using the top side of the upper run of the transfer wire as a former wire, a non-woven fabric may be distributed from a forming head above the transfer wire, the non-woven fabric being led downwards with the transfer wire and disposed upon the first non-woven fabric. Then they will be transferred jointly to the subsequent conveying wire as the joined non-woven fabric is sucked on to the underside of the lower run of the transfer wire. At the lower run of the transfer wire, between the first forming wire and the subsequent conveying wire, an embosser may be provided, so that the non-woven fabrics are led through a nip between these embossing rollers before they are laid off on the succeeding conveying wire.

The succeeding conveying wire may, as mentioned, be a forming wire on which is formed a third non-woven fabric. After formation of the wanted number of non-woven fabrics, the formed fabrics may optionally be conveyed through a treatment station in order to be sprayed on the surface, or through an oven for fixing binder fibres admixed with the fibres. The binder fibres may e.g. be polyester fibres or high denier/high Dtex fibres, possibly in combination with binder fibres having lower Dtex. These fibres may e.g. be provided in the second non-woven fabric, while the first non-woven fabric e.g. may include a combination of cellulose pulp, superabsorbers and a part of binder fibres. These combinations depend on the intended use of the formed fabric.

The formed fabric may also be consolidated by hydroentanglement. Thus there may be produced a product which is particularly suited for wipes, as the first non-woven fabric is formed by carding, the second non-woven fabric is formed by airlaying and a third non-woven fabric is formed by carding too. Then the product can be subjected to hydroentanglement. With such a product is achieved good bonding by drawing long fibres from the surface layer down into the central layers.

By forming the individual non-woven fabrics it is also possible to distribute a larger amount of binder fibres in border layers. Hereby may be achieved a better bonding between individual non-woven fabrics at the subsequent heating for activation of the binder fibres.

By making a product where the first non-woven fabric is made with a density which preferably will be greater than the density in the second non-woven fabric, it is possible to make a product with an acquisition layer upon an absorbing layer. This product will be particularly suited for sanitary towels and/or napkins.

When the method or the apparatus is used for combining airlaid non-woven fabric with high density with a further non-woven fabric with low density, it is possible to convey the non-woven fabrics through rollers, e.g. compacting rollers for adding integrity to the fabric without destructing the lower density of the top layer.

When one of the used rollers is an embossing roller, it is possible to impart a pattern and/or additional integrity in the underside of the formed fabric, which can occur without destroying the low density of the top layer.

With a method and an apparatus according to the invention, it is possible to achieve high production speeds, even by the formation of multilayered fabrics and consequently possibility of a large thickness of the fabric.

It is possible to use cards for forming the first and third layer and a former head, which is placed over the transfer wire for forming a second airlaid non-woven fabric. This may occur in a constructionally simple way, as cards normally will have a considerable height over the forming wires, whereas the transfer wire only needs to have a modest height over the forming wire. In that way it becomes possible to utilise the free space located over the transfer wire between two succeeding cards for placing one or more forming heads for forming the second non-woven fabric at the upper side of the upper run of the transfer wire.

By making products of a particular embodiment, the invention is peculiar in that the first non-woven fabric is made with a density greater than the density of the second non-woven fabric, preferably by the density of the first non-woven fabric being between 0.1 and 0.5 g/m$^3$ and the density of the second non-woven fabric being between 0.01 and 0.10 g/m$^3$.

According to a further embodiment, the method according to the invention is peculiar in that a thin layer of thermoplastic binder fibres, preferably with a basis weight between 2 and 10 g/m$^2$, is disposed in a surface layer of a non-woven fabric which is in contact with a second non-woven fabric.

Possibly, the first and second non-woven fabrics may be coupled to the transfer wire by means of a perforated roller. Hereby it becomes possible to get a more controlled application of the second layer. The perforated roller or cylinder will thus be the reversing roller situated at the corner between the downwards facing run and the lower run on the transfer wire. By using a perforated roller in which there is vacuum, the second non-woven fabric is sucked on to the transfer wire, so that it becomes possible to get a more secure control of the application when the second non-woven fabric is imparted the change of direction for the downwards movement to the horizontal movement towards the underside of the transfer wire.

DESCRIPTION OF THE DRAWING

The invention will now be explained more closely below with reference to the accompanying schematic drawing, where.

DETAILED DESCRIPTION OF THE PREFERRED EMBODIMENTS

Figure 1:
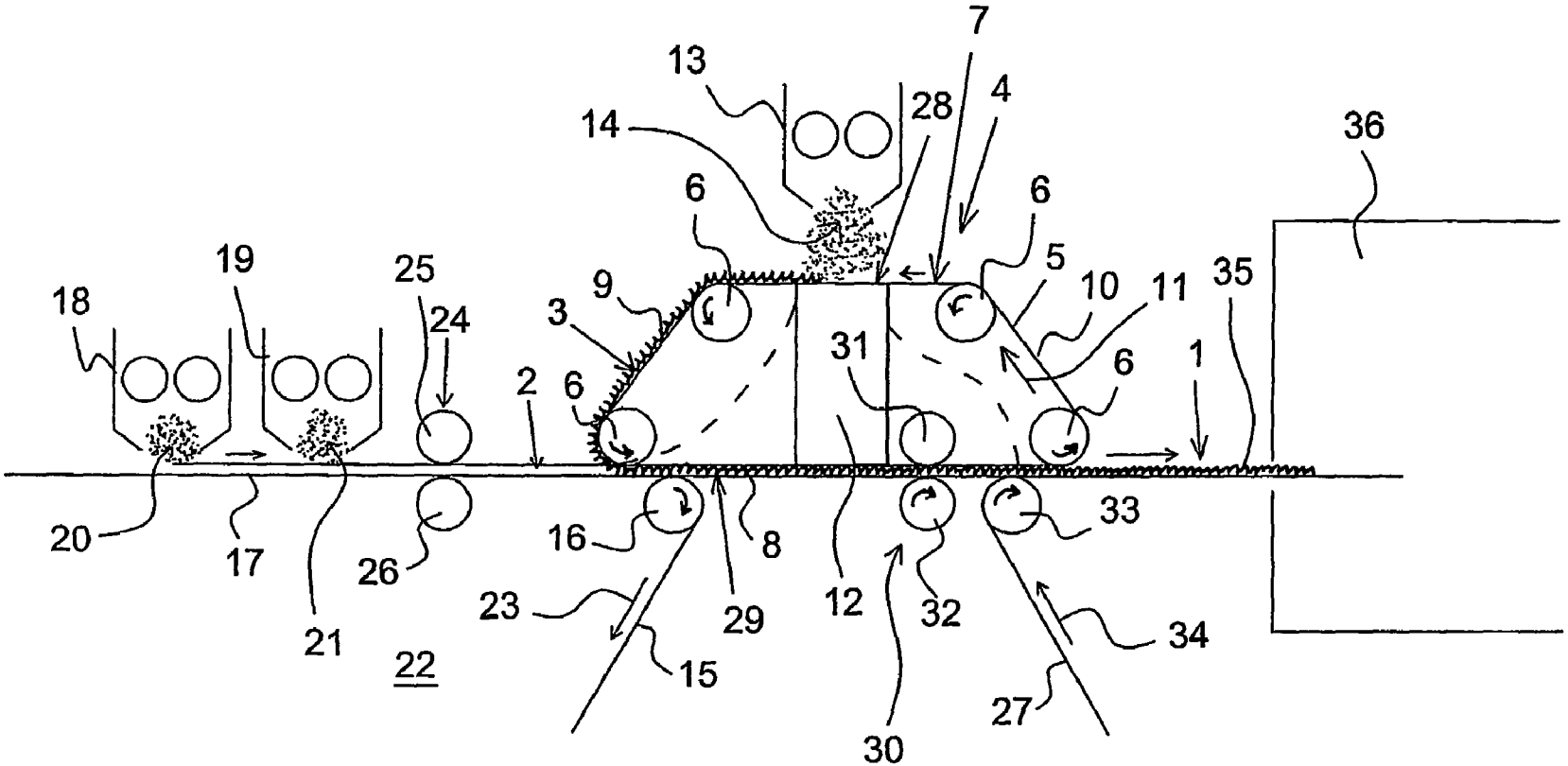
FIG. 1 shows a partial view from the side of a first embodiment of an apparatus according to the invention.

In different Figures of the drawing, identical or corresponding elements will be designated with the same reference. No specific explanation will be given to each single part of the Figures of the drawing.

In the Figures, only the most important parts of the apparatus are illustrated. In order to be functional, an apparatus requires a plurality of elements, e.g. controls, motors, supporting frames etc. However, such additional machine components also constituting part of the invention can be selected by the skilled in the art in the light of the description of the different embodiments for apparatuses according to the invention.

FIG. 1 shows an apparatus for dry forming a fabric 1 which is formed by at least two non-woven fabrics 2, 3. The apparatus includes a transfer unit 4 that includes a transfer wire 5 running about a number of reversing rollers 6. The transfer wire 5 has hereby an upper run 7, a lower run 8, a downwards oriented run 9 and an upwards oriented run 10, as the transfer wire 5 is led around in the direction indicated by an arrow 11.

Within the enclosure of the transfer wire 5, a vacuum is provided. Thus there is provided a suction box 12 exerting suction towards the upper run 7. Above the suction box 12 there is provided a forming head 13 carrying fibres 14 at the upper side of the upper run 7 for forming the non-woven fabric 3 which will be termed the second non-woven fabric in the following.

The non-woven fabric 2 will now be designated the first non-woven fabric 2. It 2 is formed on a forming wire 15 situated upstream of the transfer wire. The forming wire 15 is passed around reversing wheels 16, of which only one is illustrated. At an upper run 17 of the forming wire is formed the first non-woven fabric 2. In the embodiment illustrated in FIG. 1, the non-woven fabric 2 is formed by two forming heads 18, 19. The forming heads 18, 19 may be identical or different and may be used for moving identical or different fibres and/or fibre mixtures 20 and 21, respectively, down on the upper run 17 of the forming wire 15 for forming the first non-woven fabric 2. Within the forming wire, there is provided a suction box 22 for each forming head for forming a vacuum that holds the first non-woven fabric 2 against the forming wire 15. The forming wire 15 is conveyed in the direction indicated by an arrow 23.

Downstream of the forming heads 18, 19, as seen in the conveying direction of the forming wire 15, a compacter 24 is provided, including a roller 25 which is disposed above the non-woven fabric, and a roller 26 disposed below the forming wire 15. Hereby, the first non-woven fabric 2 is compacted. After the compacting, the transfer wire 5 is used in a traditional way to transfer the first non-woven fabric 2 from the forming wire 15 to a subsequent conveying wire 27.

The first non-woven fabric 2 will thus be sucked against the second non-woven fabric 3 formed by airlaying of the forming head 13, as this second non-woven fabric is formed on the top side 28 of the upper run 7 and is moved downwards via the downwards directed run 9 and is sucked on to the underside 29 of the lower run. Upon this second non-woven fabric, the first non-woven fabric 2 is sucked against the underside of the lower run 8 of the transfer wire due to the vacuum existing within the transfer wire 5 across the length of the lower run 8.

The fabric 1, which is formed by the combinations of the non-woven fabrics 2, 3, are conveyed through an embosser 30 that includes a roller 31 disposed above the lower run 8 of the transfer wire 5 and a roller 32 placed at the underside of the lower run 8. After passing through the embosser 30, the fabric is laid off on the top side of the conveying wire 27. The conveying wire is moved up in a reversing wheel 33, of which only one is illustrated in FIG. 1. The conveying wire 27 is moved in direction of the arrow 34. Hereby the fabric 1, which is placed on an upper run 35 of the conveying wire 27, will be conveyed to a further treating unit 36 which in the shown embodiment is illustrated as an oven.

A first embodiment of the apparatus as illustrated in FIG. 1 may e.g. be used with fibres which can contain binder fibres, e.g. polyester fibres, bicomponent fibres, or other binder fibres. By passing through the oven 36 fixation of the fabric 1 is thus provided.

Figure 2:
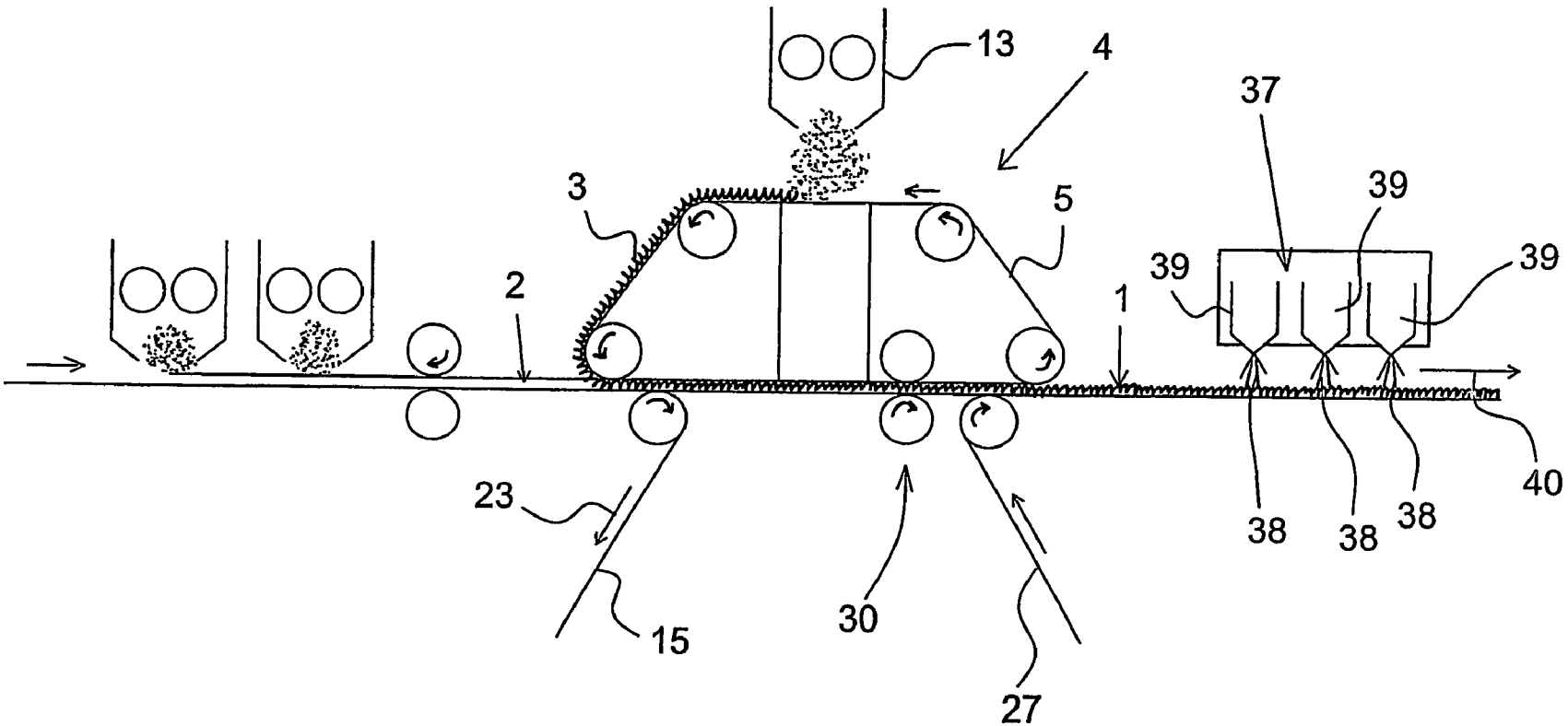
FIG. 2 shows a partial view from the side of a second embodiment of an apparatus according to the invention.

In FIG. 2 is illustrated a second embodiment of the apparatus according to the invention. In this embodiment, the transfer unit 4 is used for formation of the second non-woven fabric 3 and for transferring the first non-woven fabric 2 which is formed on the forming wire 15 disposed upstream. The conveying wire 27 in the shown embodiment moves the fabric formed of the first and second non-woven fabrics 2, 3 to a further treating unit 37. In the shown embodiment, the treating unit is an arrangement for applying latex 38 which is sprayed on the fabric 1 using nozzles 39. After applying latex, the fabric is moved according to the arrow 40 to a further treating unit which e.g. can be an oven.

Figure 3:
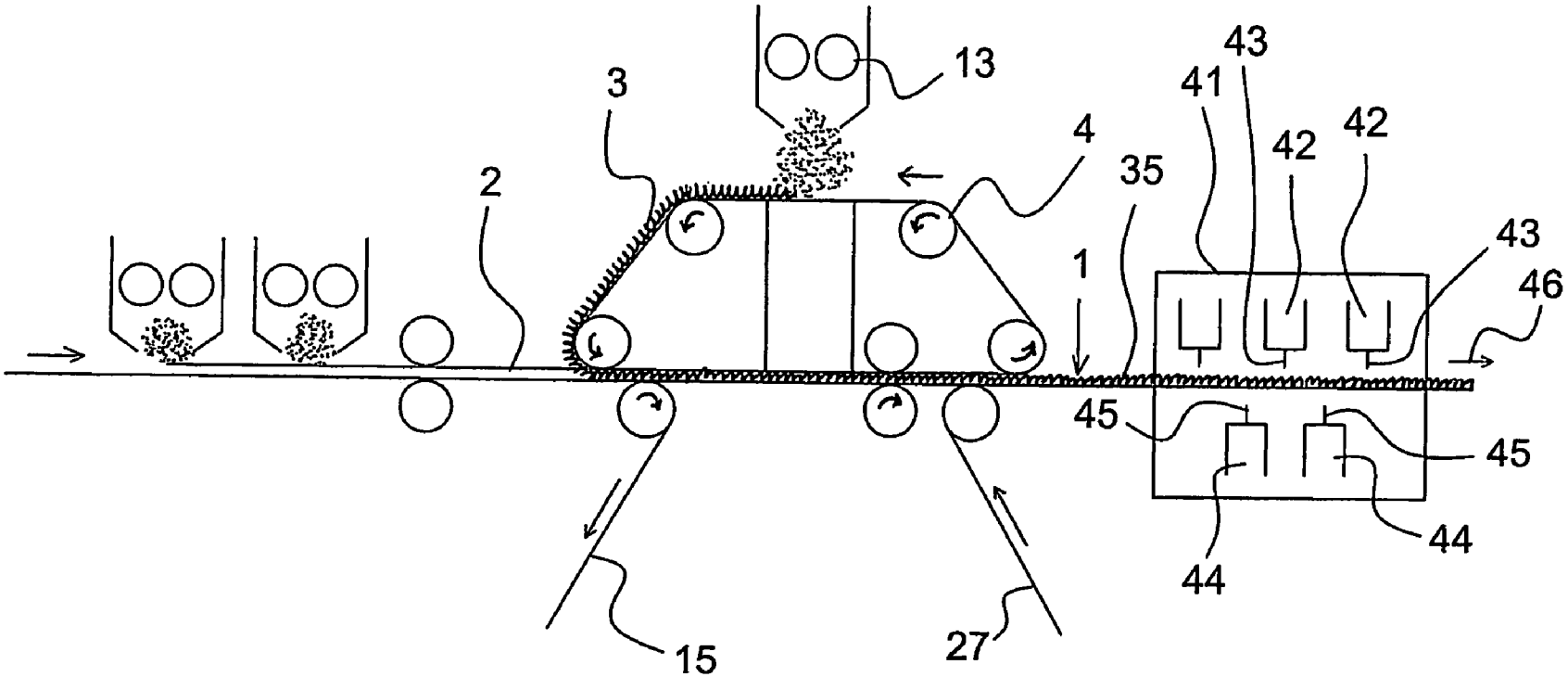
FIG. 3 shows a partial view from the side of a third embodiment of an apparatus according to the invention.

FIG. 3 also includes the transfer unit 4 over which the forming head 13 is disposed for forming the second non-woven fabric 3. In the third embodiment is also formed a first non-woven fabric 2 on the forming wire 15 which is disposed upstream in relation to the transfer unit 4.

In this third embodiment of the apparatus, the fabric is conveyed on the top side of the conveying wire 27 to a treatment unit 41. The treatment unit 41 is a hydroentanglement unit which fixes the fabric. It is constituted by a principle known per se, embodying a row of water jet nozzles 42, which are disposed above the upper run 35 of the conveying wire 27, providing downwards directed water jets 43. Below the upper run 37 of the conveying wire, other water jet nozzles 44 are provided that each forms an upwards directed water jet 45. The hydroentanglement unit 41 is shown schematically and will in practice look otherwise, but it is arranged so that fixation of the fabric 1 is achieved by a hydroentanglement known per se.

After the treatment unit 41, the fabric is conveyed further one according to the arrow 46 to a possible subsequent treatment.

Figure 4:
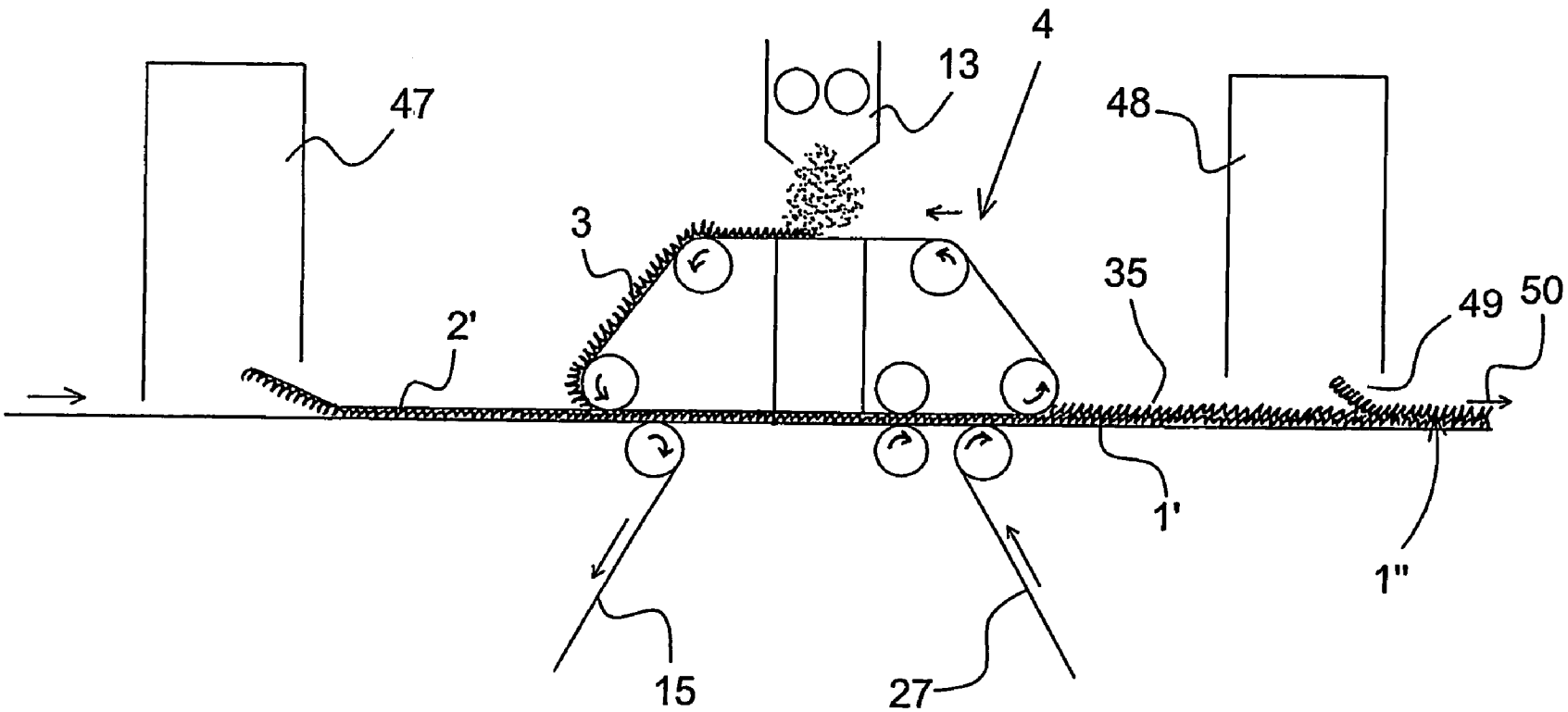
FIG. 4 shows a partial view from the side of a fourth embodiment of an apparatus according to the invention.

In the fourth embodiment illustrated in FIG. 4, the transfer unit 4 is used for forming the second non-woven fabric 3 of the fibres of the forming head 13.

In this embodiment, over the forming wire 15 there is provided a card 47 for forming the first non-woven fabric 2'. The first non-woven fabric 2' and the second non-woven fabric 3 are transferring against the lower run 8 of the transfer unit 4 to the upper run 35 of the conveying wire 27 for formation of a fabric 1'. A second card 48 is provided above the upper run 35 of the transport wire 27, laying a third non-woven fabric 49 upon the first and second non-woven fabrics 2', 3 for forming a fabric 1" which is composed by the first, second and third non-woven fabrics 2', 3, 49, respectively. The fabric 1" thus formed is then carried on according to the arrow 50 for subsequent treatment.

Of the fourth embodiment illustrated in FIG. 4, it may be said that the conveying wire 27 also constitutes a forming wire.

In the above are explained different embodiments which are not to be regarded as limiting for the invention, but only for illustrating possible embodiments. Thus it will be possible to combine the above illustrated embodiments. According to the invention there may thus be performed a variation by using several succeeding transfer wires. It is also possible that above the first forming wire there may be provided a forming head, or more than two forming heads may be provided.

With the apparatus it will be possible to produce the different non-woven fabrics 2, 2', 3, 49 with identical or different identities and with different types of fibres and/or fibre mixtures. It will thus also be possible to add fibres with different properties in the different forming heads/cards in order to adapt the properties of the finished product. Furthermore, it will also be possible to add superabsorbers in the fibre mixture for increasing the absorbing ability in the formed product.

The invention claimed is:

1. Method for dry forming of a fabric comprising:

forming a first non-woven fabric, transferring the first non-woven fabric between two forming or conveying wires by a transfer wire, forming an airlaid, second non-woven fabric at the top side of an upper run on the transfer wire by using at least one forming head, and leading the second non-woven fabric downwards and along the underside of a lower run of the transfer wire for being laid off on a subsequent conveying wire together with the first non-woven fabric.

2. Method according to claim 1, further comprising integrating the two non-woven fabrics as they are disposed at the underside of the transfer wire, while passing them between rollers during transfer to the subsequent conveying wire.

3. Method according to claim 1, characterised in that the first non-woven fabric is made by carding.

4. Method according to claim 3, further comprising integrating a web formed of plural non-woven fabrics by hydroentanglement.

5. Method according to claim 1, characterised in that the first non-woven fabric is made with a density which is greater than the density of the second non-woven fabric.

6. Method according to claim 1, further comprising disposing in the top layer of a non-woven fabric which is in contact with the second non-woven fabric, a thin layer of thermoplastic binder fibres.

7. The method of claim 5, wherein the density of the first non-woven fabric is between 0.1 and 0.5 $g/m^3$ and the density of the second non-woven fabric is between 0.01 and 0.10 $g/m^3$.

8. The method of claim 6, wherein the thin layer of thermoplastic binder fibres has a basis weight between 2 and 10 $g/m^2$.

9. Method for dry forming of a fabric comprising:

forming a first non-woven fabric in a first dry forming unit while depositing fibres on a first former wire over a vacuum box, transferring the fibre layer from the first former wire to the underside of a lower run on a transfer wirer while forming a vacuum between an upper run and the lower run of the transfer wire, forming on the top side of the upper run of the transfer wire an airlaid second non-woven fabric by using at least one former head, and sucking said first non-woven fabric against the transfer wire and thereby also against the lower run by suction action through the second non-woven fabric, and transferring the two non-woven fabrics to a subsequent conveying wire.

10. The method of claim 9, wherein the subsequent conveying wire comprises a further former wire for forming a third non-woven fabric upon the two previously formed non-woven fabrics.

11. The method of claim 10, wherein the third non-woven fabric is a carded non-woven fabric.

12. Apparatus for dry forming of a fabric which is formed by at least two non-woven fabrics comprising:

a transfer wire disposed after a first former wire used for forming a first non-woven fabric, at least one former head placed at the top side of an upper run of the transfer wire, and a vacuum box provided between the upper run and a lower run of the transfer wire.

13. Apparatus according to claim 12, further comprising a card for forming the first non-woven fabric at each side of the transfer wire and a third non-woven fabric at each side of the transfer wire over the non-woven fabric formed on the transfer wire.

14. Apparatus according to claim 12, further comprising a former head above the first former wire.

* * * * *